US011679593B2

(12) United States Patent
Takenaga

(10) Patent No.: US 11,679,593 B2
(45) Date of Patent: Jun. 20, 2023

(54) RECORDING APPARATUS

(71) Applicant: CANON KABUSHIKI KAISHA, Tokyo (JP)

(72) Inventor: Ken Takenaga, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 23 days.

(21) Appl. No.: 17/532,336

(22) Filed: Nov. 22, 2021

(65) Prior Publication Data

US 2022/0169028 A1 Jun. 2, 2022

(30) Foreign Application Priority Data

Nov. 27, 2020 (JP) ..... JP2020-197650

(51) Int. Cl.
*B41J 2/175* (2006.01)
*B41J 2/21* (2006.01)

(52) U.S. Cl.
CPC ..... *B41J 2/17506* (2013.01); *B41J 2/17509* (2013.01); *B41J 2/17523* (2013.01); *B41J 2/21* (2013.01)

(58) Field of Classification Search
CPC .... B41J 2/175; B41J 2/17506; B41J 2/17509; B41J 2/1752; B41J 2/17523; B41J 2/17553; B41J 2/21; B41J 29/02; B41J 29/38
See application file for complete search history.

(56) References Cited

U.S. PATENT DOCUMENTS

2016/0200114 A1* 7/2016 Nanjo ..... B41J 2/17546 347/86

FOREIGN PATENT DOCUMENTS

JP 2017081122 A 5/2017

* cited by examiner

*Primary Examiner* — Anh T Vo
(74) *Attorney, Agent, or Firm* — Canon U.S.A., Inc. I.P. Division

(57) ABSTRACT

A recording apparatus includes a first connecting unit which is connectable to a first supply portion to supply a first-color ink into a recording head to eject the first-color ink, and a first prevention unit which prevents the first-color ink through a first supply path from being discharged from a second connecting portion, the second connecting portion being not connected to the recording head. The recording head includes the first supply portion without a portion to supply a second-color ink into the recording head.

8 Claims, 11 Drawing Sheets

CROSS SECTION ALONG LINE A-A

CROSS SECTION ALONG LINE A-A

RECORDING APPARATUS

BACKGROUND

Field of the Disclosure

The present disclosure relates to recording apparatuses.

Description of the Related Art

Japanese Patent Application Laid-Open No. 2017-81122 discusses a recording apparatus including a carriage in which a recording head is detachably installed, a supply tube through which ink is supplied to the recording head, a joint unit that connects the supply tube to the recording head, and a cover mounted to the carriage in an openable manner. Each color of ink is stored in an ink tank including an ink filling port from which the ink is poured, and the ink is supplied from the ink tank to the recording head via the supply tube.

In the technique discussed in Japanese Patent Application Laid-Open No. 2017-81122, one joint unit engages with one recording head. In other words, one type of recording head allows ink to be continuously supplied to the corresponding one joint unit.

According to the method discussed in Japanese Patent Application Laid-Open No. 2017-81122, supplying ink continuously to two or more types of recording head involves mounting joints at two locations, which can increase the size of the apparatus.

SUMMARY

In view of these circumstances, the present disclosure provides for a recording apparatus allowing continuous supply of ink to each of the recording heads different in ink type from one another for use installed in a recording head installation portion.

According to an aspect of the present disclosure, a recording apparatus includes an installation unit in which a recording head to eject ink to perform recording on a recording medium is detachably installed, a first storage unit including an ink filling port and configured to store first-color ink, a second storage unit including an ink filling port and configured to store second-color ink, a first supply path through which the first-color ink stored in the first storage unit is supplied to the installation unit, a second supply path through which the second-color ink stored in the second storage unit is supplied to the installation unit, a first connecting portion, provided in the installation unit, configured to be connected to the recording head installed in the installation unit, and to connect to the first supply path, and a second connecting portion, provided in the installation unit, configured to be connected to the recording head installed in the installation unit and to connect to the second supply path. In a case where the recording head installed in the installation unit includes a first-color ink supply portion to allow the first-color ink into inside of the recording head and does not include a second-color ink supply portion to allow the second-color ink into the inside of the recording head, the first connecting portion is connected to the first-color ink supply portion and a first prevention unit prevents the first-color ink supplied through the first supply path from being discharged from the second connecting portion, the second connecting portion being not connected to the recording head configured to eject the first-color ink. In a case where the recording head installed in the installation unit includes the second-ink supply portion and does not include the first-ink supply portion, the second connecting portion is connected to the second-ink supply portion and a second prevention unit prevents the first-color ink supplied through the first supply path from being discharged from the first connecting portion, the first connecting portion being not connected to the recording head configured to eject the second-color ink.

Further features of the present disclosure will become apparent from the following description of exemplary embodiments with reference to the attached drawings.

DESCRIPTION OF THE EMBODIMENTS

Hereinafter, a first exemplary embodiment will be described in detail with reference to the drawings. Like numbers refer to like elements having identical functions and redundant descriptions thereof may be omitted.

Figure 1:
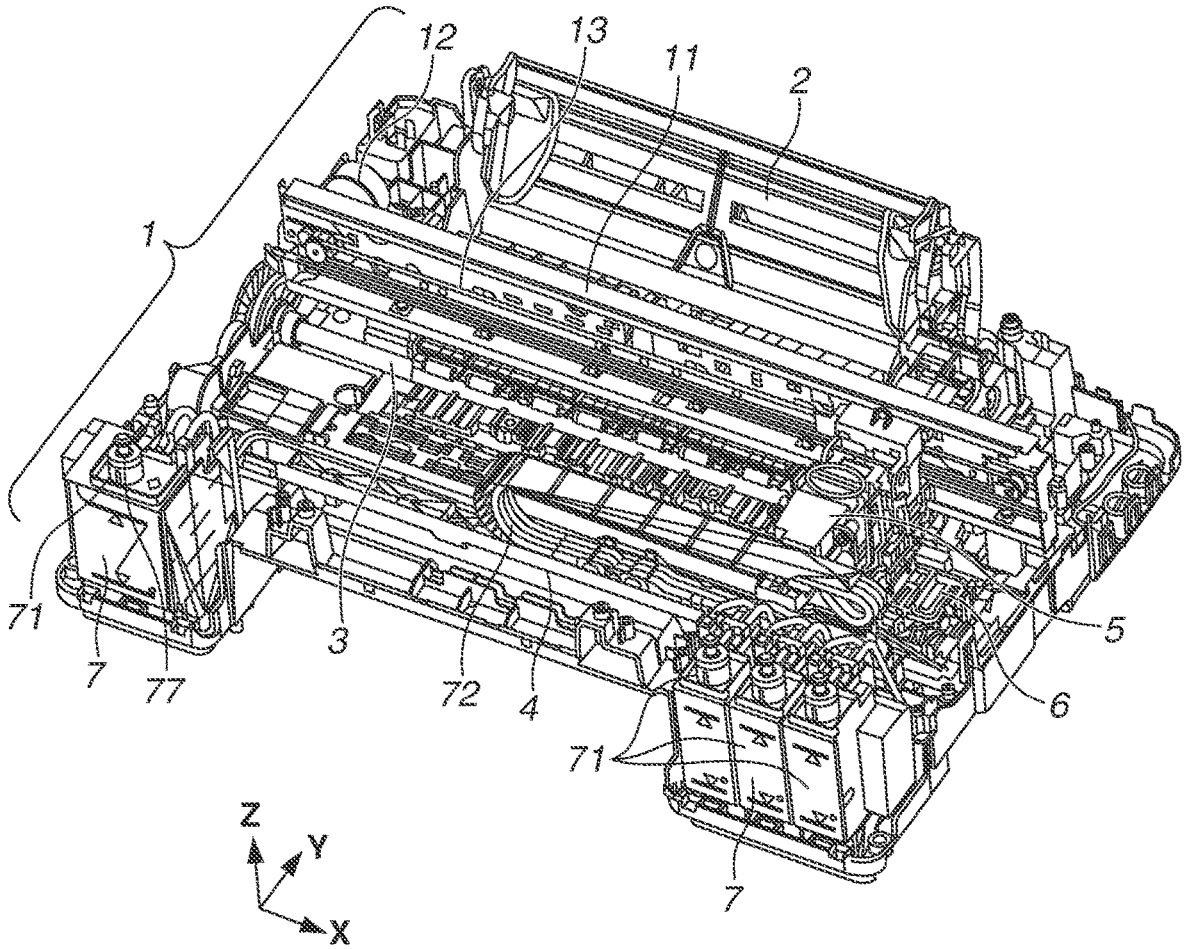
FIG. 1 is a perspective view illustrating an inkjet recording apparatus according to a first exemplary embodiment.
Figure 2:
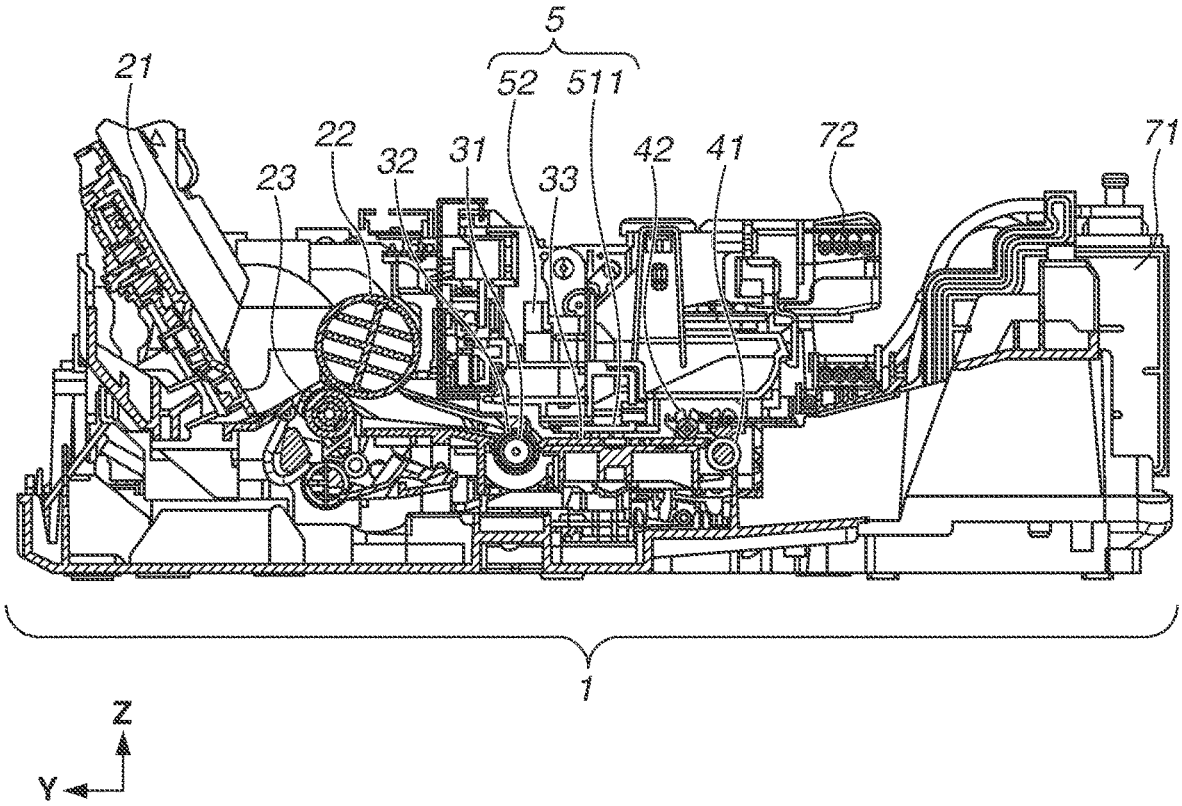
FIG. 2 is a sectional view illustrating the inkjet recording apparatus according to the first exemplary embodiment.

FIG. 1 is a perspective view illustrating an inkjet recording apparatus 1 according to the first exemplary embodiment. FIG. 2 is a sectional view illustrating the inkjet recording apparatus 1 according to the first exemplary embodiment.

The inkjet recording apparatus 1 includes a feeding unit 2 to feed sheets (recording media), a conveyance unit 3 to convey each recording medium, a discharging unit 4 to discharge the recording medium, and a recording unit 5 to record an image on the recording medium. The inkjet recording apparatus 1 also includes a maintenance unit 6, which will be described below, and an ink supply unit 7.

In the feeding unit 2, recording media loaded on a pressure plate 21 are separated by a pickup roller 22 and a separation roller 23 one by one, and each separated recording medium is fed to the conveyance unit 3. The recording medium fed to the conveyance unit 3 comes into contact with a main conveyance roller 31 to be stopped or rotated in the reverse direction and a driven roller 32, which correct a skew of the recording medium (a skew correcting operation). Subsequently, the recording medium is nipped by the main conveyance roller 31 and the driven roller 32 and conveyed to the recording unit 5. A recording head 511 positioned opposite the recording medium conveyed to the recording unit 5 ejects ink to form an image onto the recording medium supported from below by a platen 33.

The recording unit 5 includes the recording head 511 and a carriage 52 as an installation unit in which the recording head 511 is installed. The recording head 511 is detachably installed in the carriage 52. The carriage 52 is movably supported by a chassis 11 in a direction (a second direction) intersecting with the recording medium conveyance direction (a first direction) with the recording head 511 installed. The carriage 52 moves in the second direction by driving of a carriage motor 12 transmitted to a transmission belt 13. The recording head 511 ejects ink to the recording medium to form an image in one band while the carriage 52 is moving in the second direction. The recording medium with the image in one band thereon is intermittently conveyed in the first direction by a predetermined conveyance amount for formation of an image in next one band. The intermittent conveyance operation and the image forming operation are alternately repeated, forming an image on the entire recording medium. The recording medium with the image thereon is conveyed to the discharging unit 4. The recording medium conveyed to the discharging unit 4 is discharged to a discharge tray (not illustrated) by a discharge roller 41 and a spur 42.

The maintenance unit 6 to carry out maintenance of the recording head 511 is disposed in one end portion of the carriage movable area. The maintenance unit 6 includes a cap to cover the ink ejection port disposed in the recording head 511. The cap covering the ink ejection port prevents evaporation of ink from the ink ejection port. In addition, the maintenance unit 6 includes a suction recovery mechanism to suction ink from the ink ejection port by using a tube and a pump with the ink ejection port covered with the cap to recover recording performance of the recording head 511.

The ink supply unit 7 is disposed in the front of the apparatus body. The ink supply unit 7 includes a plurality of ink tanks 71 as ink storage units that store inks. In the ink tanks 71 illustrated in FIG. 1, the ink tank for black is disposed on the left side, whereas the ink tanks for cyan, magenta, and yellow are disposed on the right side. Each of the ink tanks 71 includes an ink filling port 77 from which the corresponding ink is poured. As illustrated in FIG. 1, the ink filling port 77 is covered with the cap. A user can pour ink into each ink tank 71 from the ink filling port 77 to replenish the tank 71 with the corresponding ink. The ink stored in each ink tank 71 is supplied to the recording head 511 via a supply tube 72. The supply of ink from the ink tanks 71 enables the recording head 511 to eject ink in printing, allowing image formation on recording media.

Figure 3:
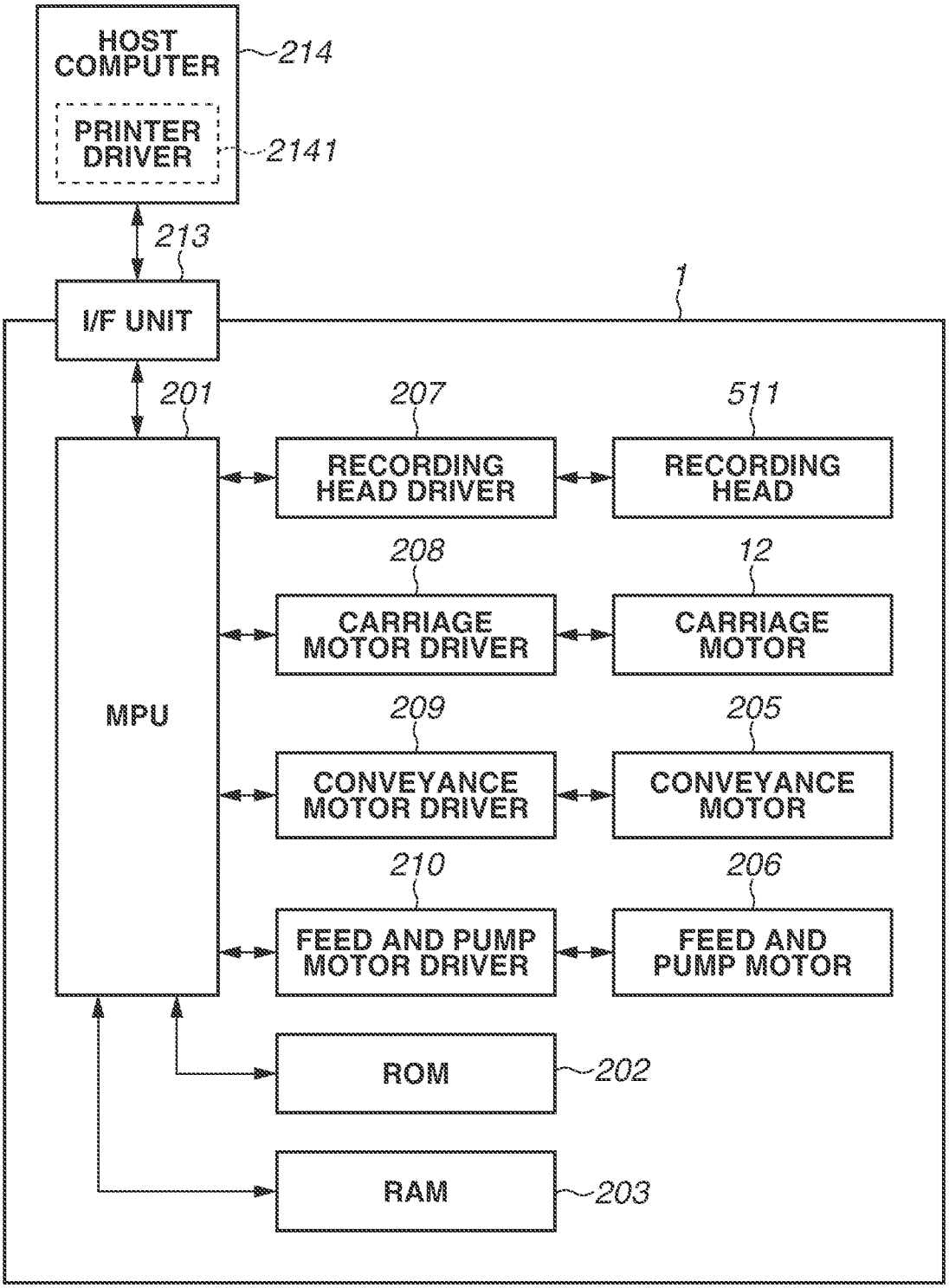
FIG. 3 is a block diagram schematically illustrating a recording operation performed by the inkjet recording apparatus.

FIG. 3 is a block diagram schematically illustrating a recording operation performed by the inkjet recording apparatus 1. A micro processing unit (MPU) 201 controls operation and processing such as the operation performed by each unit and data processing. A read only memory (ROM) 202 stores data and programs to be run by the MPU 201. A random access memory (RAM) 203 temporarily stores processing data to be used by the MPU 201 and data received from a host computer. A recording head driver 207 controls the recording unit 5. A carriage motor driver 208 controls the carriage motor 12, which drives the carriage 52. A conveyance motor 205 drives a conveyance roller (a synchronously-driven discharging roller) of the conveyance unit 3. A conveyance motor driver 209 controls the conveyance motor 205. A feed and pump motor 206 drives a feed roller of the feeding unit 2 and a pump of the maintenance unit 6. A feed and pump motor driver 210 controls the feed and pump motor 206. A host computer 214 includes a printer driver 2141 to organize recording information such as an image to be recorded to communicate with the recording apparatus in response to an instruction issued by a user. The MPU 201 exchanges data such as image data to be recorded with the host computer 214 via an interface (I/F) unit 213. The MPU 201 performs processing on the image data to be recorded acquired from the host computer 214 based on parameters or programs stored in the ROM 202 while using the RAM 203 as a storing destination of temporary data. Then, the MPU 201 transfers the resultant data for recording to the recording head 511 via the recording head driver 207, and the recording head 511 performs recording based on the transferred data.

Figure 4:
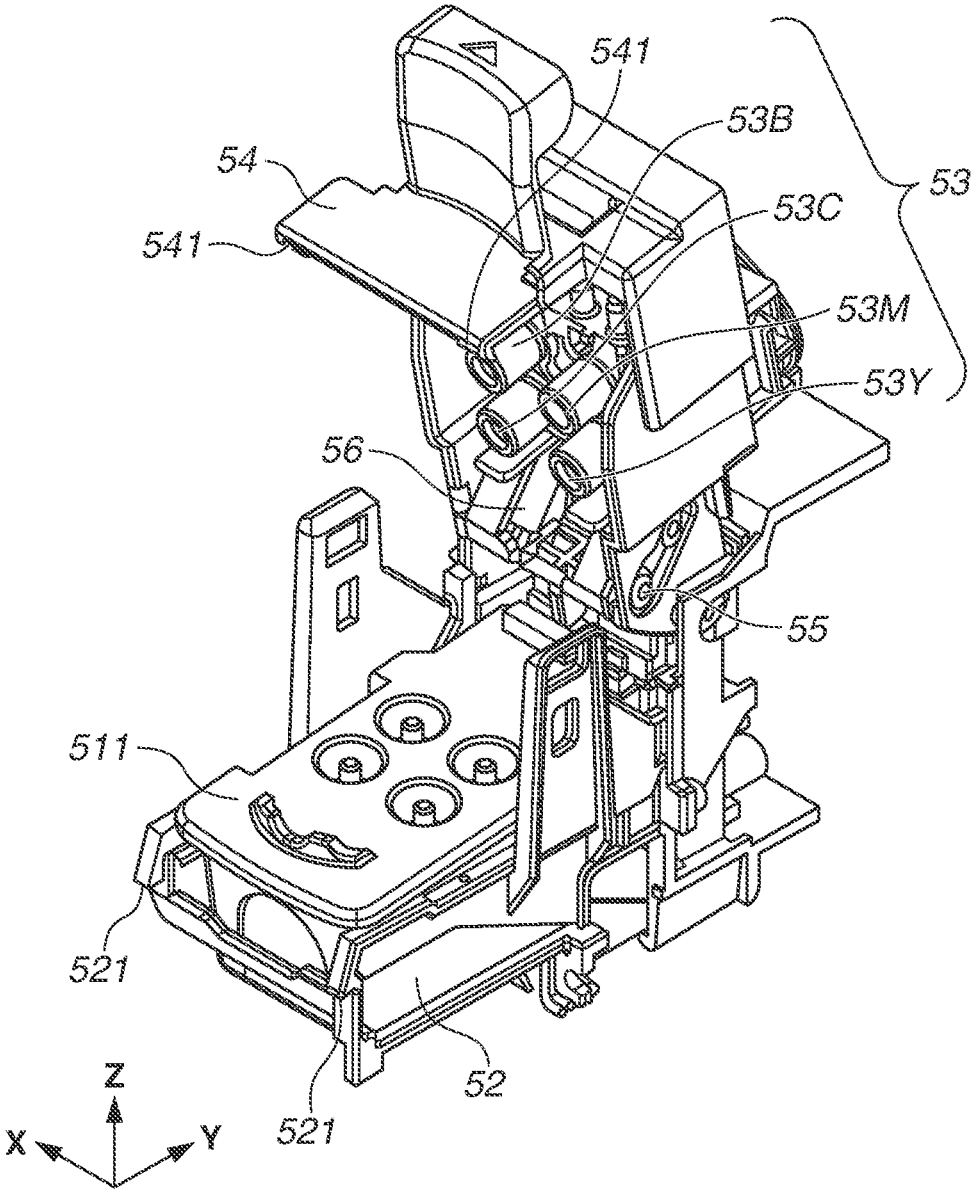
FIG. 4 is a perspective view illustrating a carriage unit with the cover opened according to the first exemplary embodiment.

FIG. 4 is a perspective view illustrating the recording unit 5 with the cover opened according to the first exemplary embodiment. The carriage 52 includes a head joint 53 and a head cover 54. The carriage 52 also includes head cover engagement receiving portions 521. The head joint 53 includes connecting portions for supply of ink to a recording head 511. More specifically, the head joint 53 includes a black-ink connecting portion 53B, a cyan-ink connecting portion 53C, a magenta-ink connecting portion 53M, and a yellow-ink connecting portion 53Y. The recording head 511 is fixed to the carriage 52 while receiving a predetermined load applied by a head set cam 55 and a head set cam spring 56, which are included in the head cover 54.

Figure 5A:
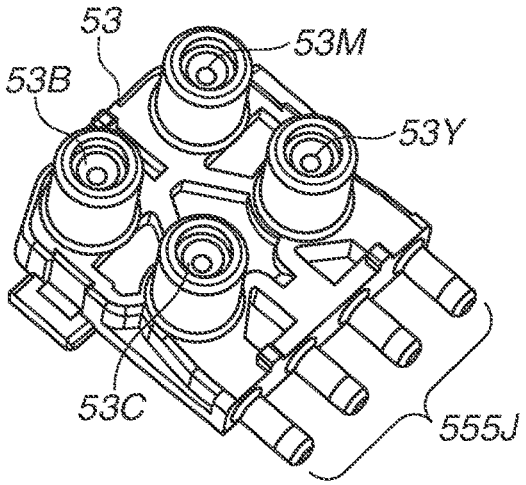
FIGS. 5A to 5D are diagrams each illustrating a joint according to the first exemplary embodiment.
Figure 5B:
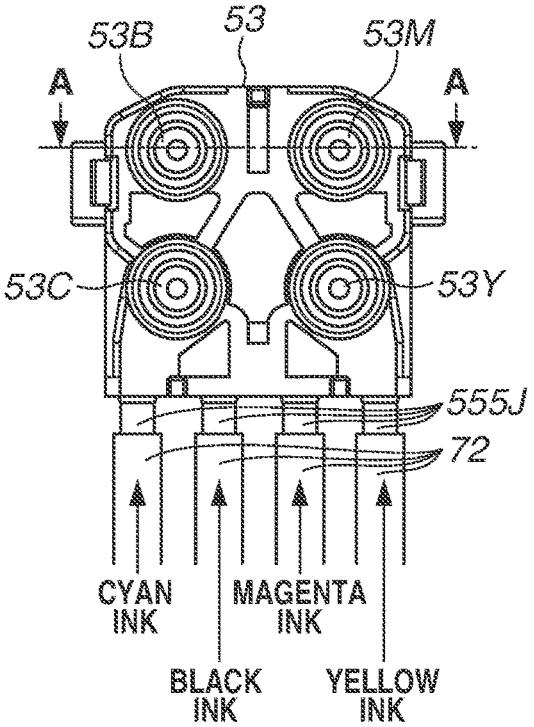
Figure 5C:
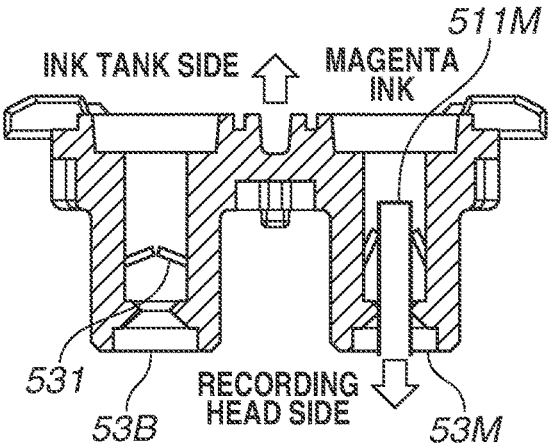
Figure 5D:
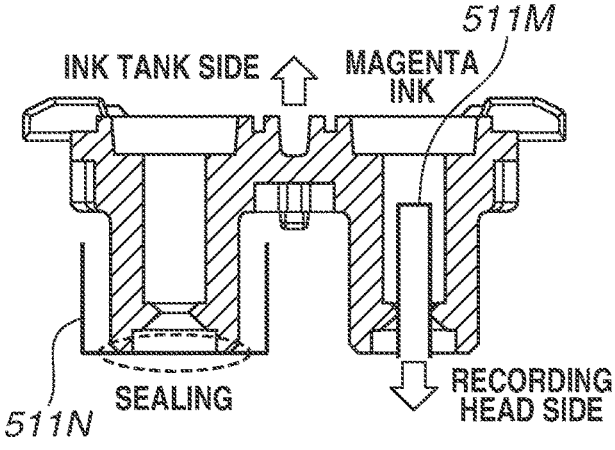

FIGS. 5A through 5D are diagrams each illustrating the joint according to the first exemplary embodiment. The head joint 53 includes the connecting portions to supply ink to the recording head 511. More specifically, as illustrated in FIG. 5A, the head joint 53 includes the black-ink connecting portion 53B, the cyan-ink connecting portion 53C, the magenta-ink connecting portion 53M, and the yellow-ink connecting portion 53Y. As illustrated in FIG. 5B, each color ink is continuously supplied with the ink tank and the supply tube 72 as an ink supply path connected to a tube connecting portion 555J. FIG. 5C is a cross section along the line A-A of FIG. 5B. As illustrated in FIG. 5C, a head joint valve 531 is disposed in a tubular flow path of the connecting portion of each color. For example, a magenta-ink supply portion 511M including magenta ink is connected to the magenta-ink connection portion 53M, opening the head joint valve 531 to allow ink supply. With the magenta-ink supply portion 511M not connected to the magenta-ink connection portion 53M, the head joint valve 531 is closed, preventing ink discharge due to ink leakage. FIG. 5D is a cross section along the line A-A of FIG. 5B. As illustrated in FIG. 5D, a head joint 511N may be in contact with an engagement portion of the connecting portion to seal the engagement portion, the engagement portion of which is to be engaged with the recording head, preventing ink leakage.

Figure 6:
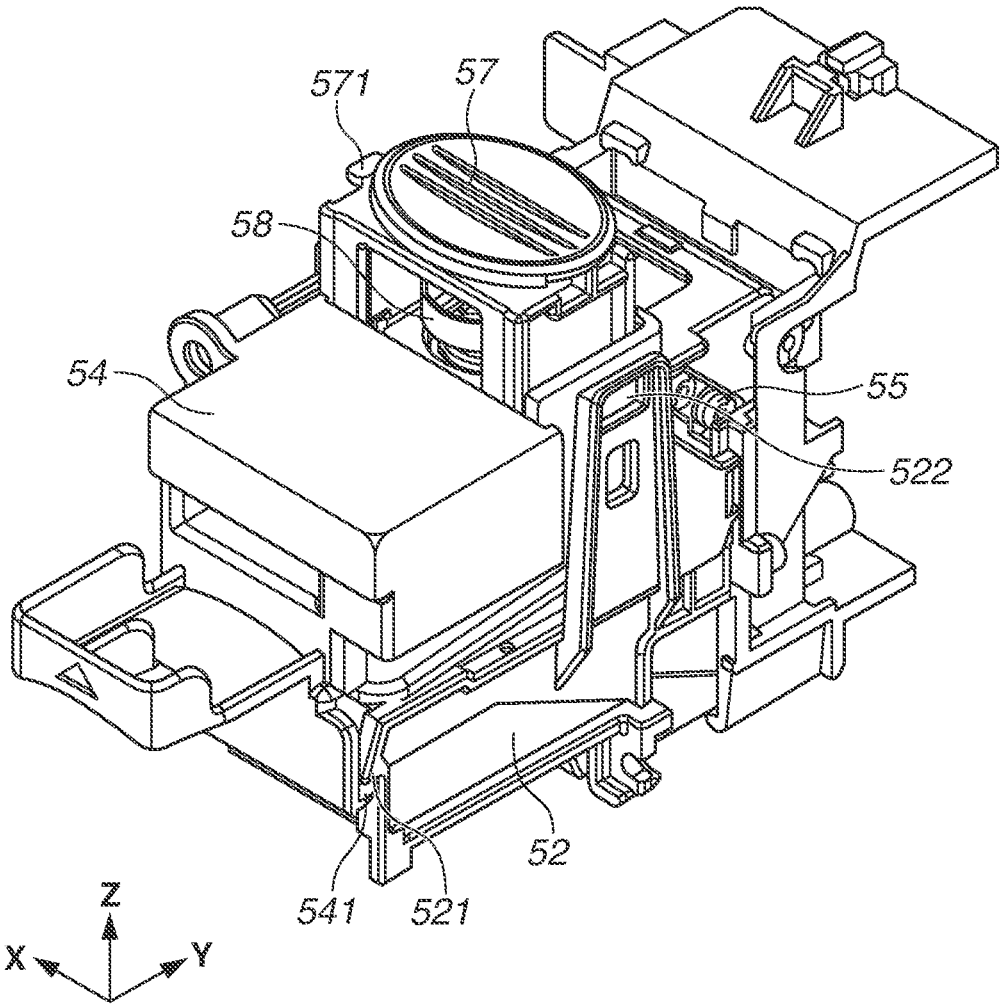
FIG. 6 is a perspective view illustrating the carriage unit with the cover closed according to the first exemplary embodiment.

FIG. 6 is a perspective view illustrating the carriage unit with the cover closed according to the first exemplary embodiment. The head cover 54 is turned and closed, and each of head cover engagement portions 541 are engaged with the corresponding head cover engagement receiving portion 521 of the carriage 52. The recording head 511 is fixed to the carriage 52 while receiving a predetermined load applied by the head set cam 55 and the head set cam spring 56 on the head cover 54.

Figure 7:
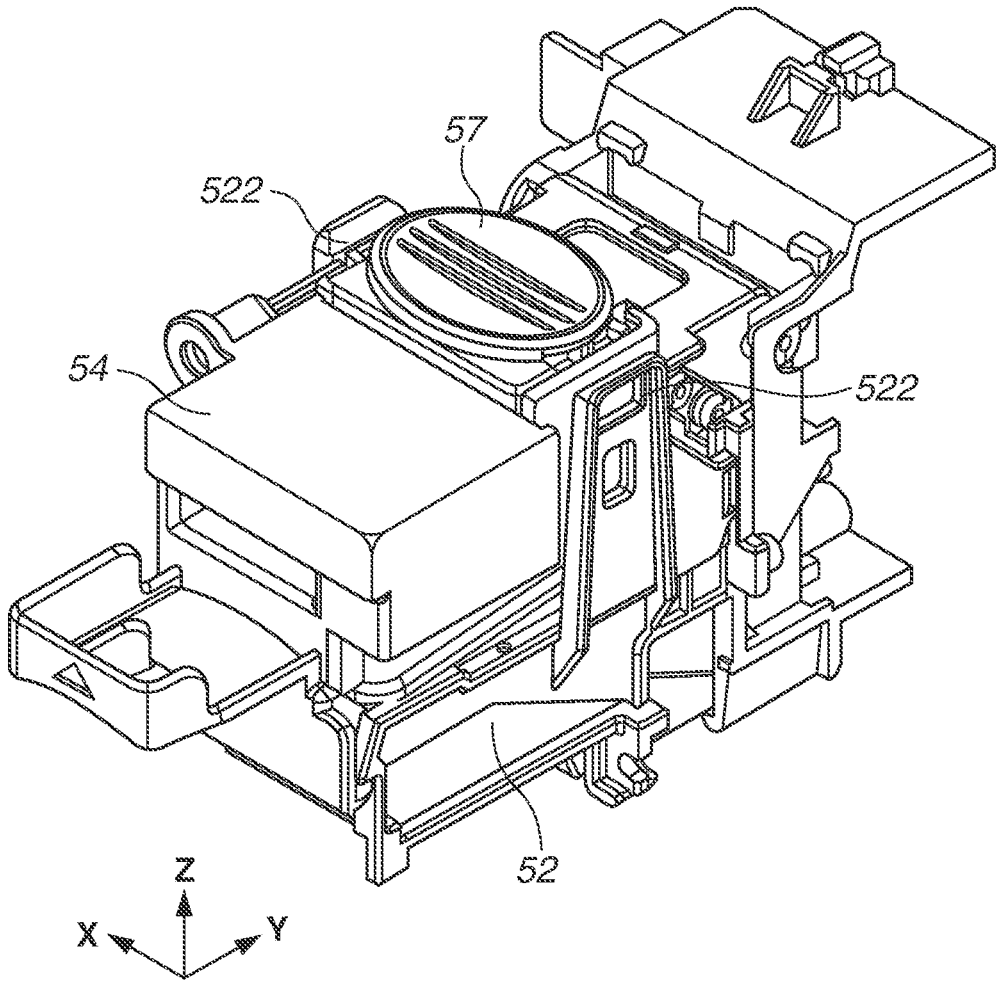
FIG. 7 is a perspective view illustrating the carriage unit in a joint inserted state according to the first exemplary embodiment.

FIG. 7 is a perspective view illustrating the carriage unit in a joint inserted state according to the first exemplary embodiment. A head joint cover 57 and a head joint cover spring 58 to move the head joint 53 are included in the head cover 54. Pressing down the head joint cover 57 causes a head joint cover engagement portion 571 to be engaged with a head joint cover engagement receiving portion 522 of the carriage, connecting the head joint 53 to the recording head 511.

Figure 8A:
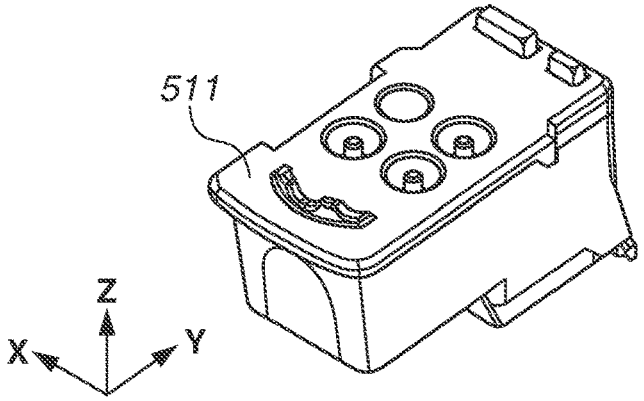
FIGS. 8A to 8C are perspective views and a top view each illustrating a recording head according to the first exemplary embodiment.
Figure 8B:
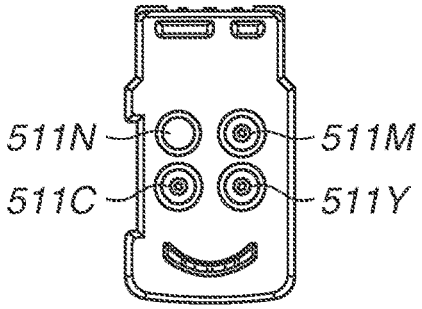
Figure 8C:
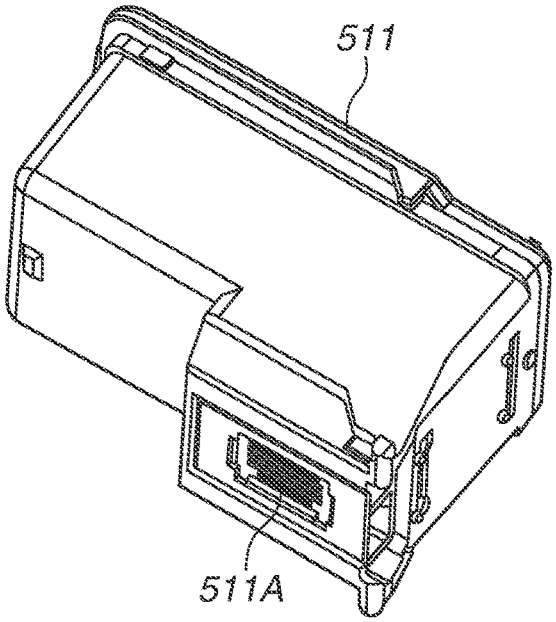

FIGS. 8A, 8B, and 8C are respectively a perspective view, a top view, and a perspective view each illustrating the recording head according to the first exemplary embodiment.

As illustrated in FIGS. 8A and 8B, the recording head 511 is a color ink recording head for chromatic colors, and includes the magenta-ink supply portion 511M, a cyan-ink supply portion 511C, and a yellow-ink supply portion 511Y. A recording head chip 511A enables recording with cyan ink, magenta ink, and yellow ink for color recording. With the head joint 53 inserted, the cyan-ink connecting portion 53C, the magenta-ink connecting portion 53M, and the yellow-ink connecting portion 53Y are connected to the cyan-ink supply portion 511C, the magenta-ink supply portion 511M, and the yellow-ink supply portion 511Y, respectively, ready to perform continuous supply of ink. The portion 511N to be engaged with the black-ink connecting portion 53B has a recessed shape, preventing the black-ink connecting portion 53B from being connected to the ink supply portion.

Figure 9A:
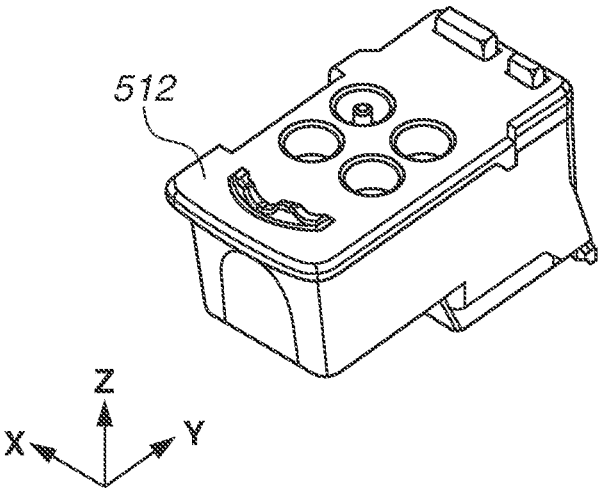
FIGS. 9A and 9B are a perspective view and a top view each illustrating the recording head according to the first exemplary embodiment.
Figure 9B:
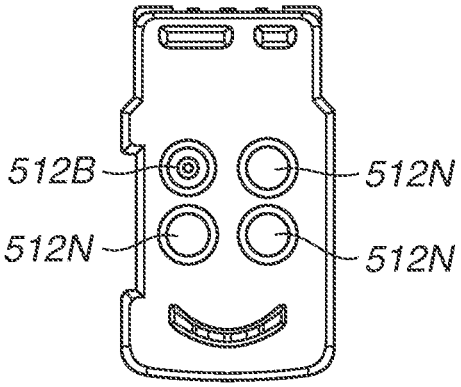

Each of FIGS. 9A and 9B illustrates a black-ink recording head 512 according to the present exemplary embodiment. With the head joint 53 inserted, the black-ink connecting portion 53B is connected to a black-ink supply portion 512B, ready to perform continuous supply of the ink. Moreover, portions 512N each to be engaged with the cyan-ink connecting portion 53C, the magenta-ink connecting portion 53M, and the yellow-ink connecting portion 53Y have recessed shapes, preventing each of the connecting portions 53C, 53M, and 53Y from being connected to the corresponding one of the ink supply portions.

Thus, a configuration such as that including the head joint 53 and the recording head 511 or 512 allows the recording head to serve for continuous supply of ink to be optionally selected in the head joint in a certain form.

Figure 10A:
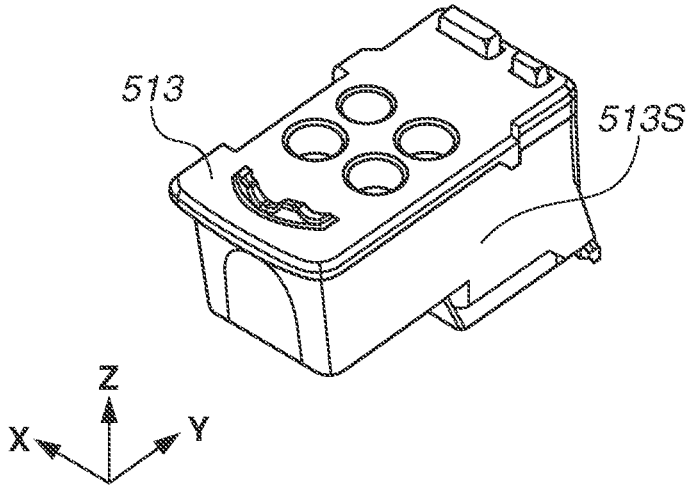
FIGS. 10A and 10B are a perspective view and a top view each illustrating a recording head according a second exemplary embodiment.
Figure 10B:
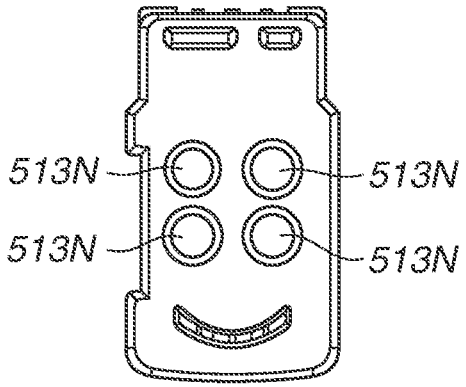

A second exemplary embodiment will be described. A recording head 513 illustrated in FIGS. 10A and 10B is a special-color-ink recording head without an ink supply portion. For example, the recording head 513 ejects ink such as ink containing silver nanoparticles, pigment ink that fluoresces in a visible range, blue, red, and green color inks as colors other than the three primary colors described with reference to FIG. 6, and clear ink that gives glossiness to printed objects. The recording head 513 includes a chip for ejection similarly to the recording head described in the first exemplary embodiment. With a head joint 53 inserted, individual portions 513N to be engaged with a black-ink connecting portion 53B, a cyan-ink connecting portion 53C, a magenta-ink connecting portion 53M, and a yellow-ink connecting portion 53Y, respectively, have recessed shapes, preventing the connection of each of the connecting portions 53B, 53C, 53M and 53Y to the corresponding one of the ink supply portions. The recording head 513 can be installed in a carriage 52, and can eject special color ink stored in an ink tank 513S.

A configuration such as that including the head joint 53 and the recording head 513 allows use of an ink head such as a special-color-ink recording head that does not serve for continuous supply of ink in the head joint in a certain form.

Figure 11:
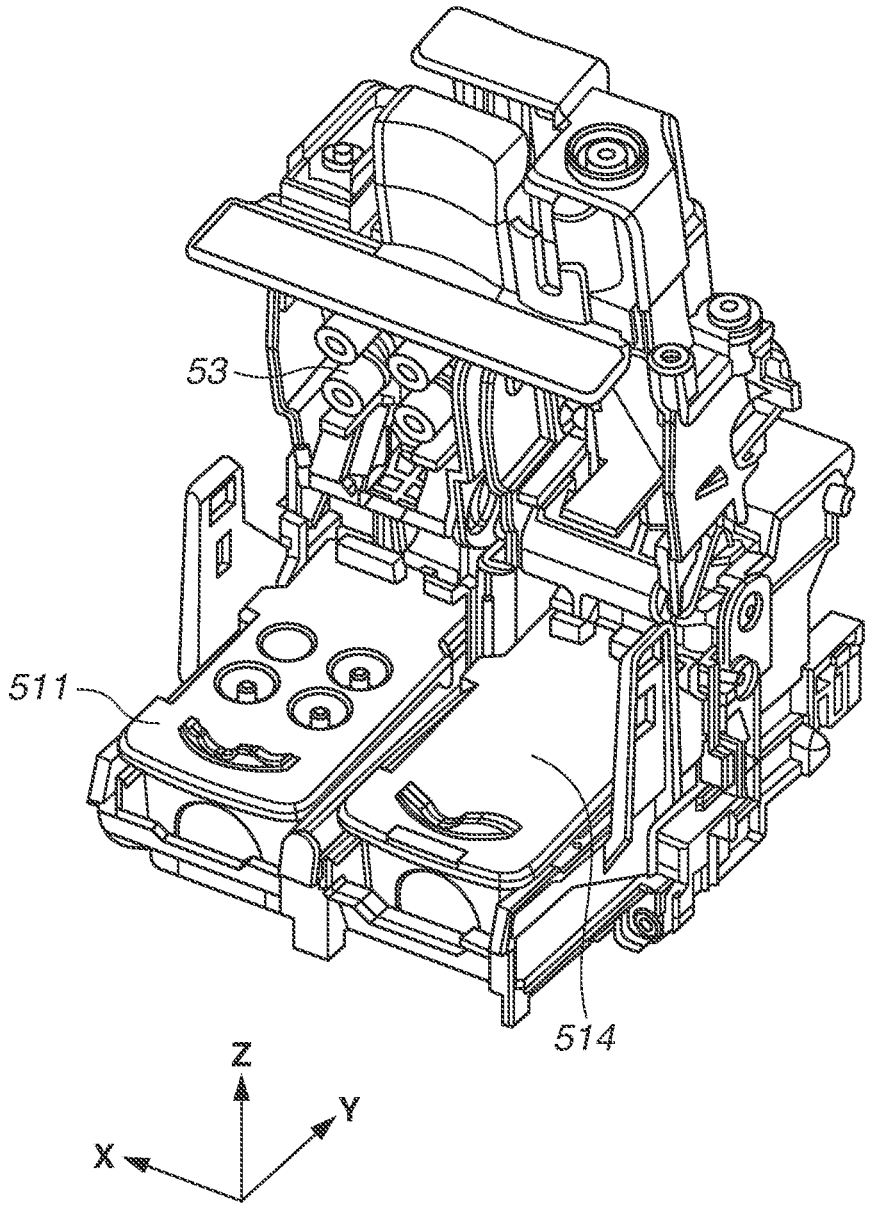
FIG. 11 is a perspective view illustrating a carriage with the cover opened according to a third exemplary embodiment.

A third exemplary embodiment will be described. FIG. 11 is a perspective view illustrating a carriage with the cover opened according to the third exemplary embodiment. In the third exemplary embodiment, two recording heads are included. One is a recording head 514, which does not include any portion to be engaged with a head joint 53, and the recording head 514 is a black-ink recording head or a color-ink recording head. The other is a recording head 511 having a shape allowing connection or non-connection of the head joint 53 to be selected. In some embodiments, a black-ink recording head 512 or a special-color recording head 513 is used instead of the recording head 511. For example, the recording head 514 as a black-ink recording head and a color-ink recording head 511 as the other head included together allows color printing. The recording head 514 as a black-ink recording head and a black-ink recording head 512 as the other head included together, allowing black ink ejection by the two recording heads, offering approximately double recording density. For example, to print a high-density portion, one printed object is produced through one reciprocating movement of the carriage, without two reciprocating movement of the carriage, reducing of printed object formation time. The recording head 514 as a black-ink recording head and a special-color ink recording head 513 as the other head included together normally serves in monochrome printing, and can serve in special color printing as a user option. That configuration meets various needs of users.

According to the exemplary embodiments of the present disclosure, an apparatus with no increase in its size provides continuous supply of ink to each of the recording heads different in ink type for use from one another installed in a recording head installation portion.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2020-197650, filed Nov. 27, 2020, which is hereby incorporated by reference herein in its entirety.

What is claimed is:

1. A recording apparatus comprising:

an installation unit in which a recording head to eject ink to perform recording on a recording medium is detachably installed;

a first storage unit including an ink filling port and configured to store first-color ink;

a second storage unit including an ink filling port and configured to store second-color ink;

a first supply path through which the first-color ink stored in the first storage unit is supplied to the installation unit;

a second supply path through which the second-color ink stored in the second storage unit is supplied to the installation unit;

a first connecting portion, provided in the installation unit, configured to be connected to the recording head installed in the installation unit and to connect to the first supply path; and a second connecting portion, provided in the installation unit, configured to be connected to the recording head installed in the installation unit and to connect to the second supply path, wherein in a case where the recording head installed in the installation unit includes a first-color ink supply portion to allow the first-color ink into inside of the recording head and does not include a second-color ink supply portion to allow the second-color ink into the inside of the recording head, the first connecting portion is connected to the first-color ink supply portion and a first prevention unit prevents the first-color ink supplied through the first supply path from being discharged from the second connecting portion, the second connecting portion being not connected to the recording head configured to eject the first-color ink, and wherein in a case where the recording head installed in the installation unit includes the second-ink supply portion and does not include the first-ink supply portion, the second connecting portion is connected to the second-ink supply portion and a second prevention unit prevents the first-color ink supplied through the first supply path from being discharged from the first connecting portion, the first connecting portion being not connected to the recording head configured to eject the second-color ink.

2. The recording apparatus according to claim 1, further comprising the first prevention unit.

3. The recording apparatus according to claim 1, further comprising the second prevention unit.

4. The recording apparatus according to claim 1, wherein the first prevention unit is a valve provided inside the second connecting portion.

5. The recording apparatus according to claim 1, wherein the recording head includes the first prevention unit to contact the second connecting portion.

6. The recording apparatus according to claim 1, wherein the recording head which does not include the second-ink supply portion ejects black ink and the recording head which does not include the first-ink supply portion ejects chromatic color ink.

7. The recording apparatus according to claim 1, wherein another recording head configured to eject the first-color ink is installable together with the first recording head in the installation unit, and wherein the first-color ink from the first storage unit is supplied to the other recording read.

8. The recording apparatus according to claim 1, comprising a plurality of storage units including a storage unit configured to store the first-color ink and a storage unit configured to store the second-color ink, wherein a recording head configured to eject ink of a type different from all types of ink stored in the plurality of storage units is installable.

* * * * *